US008047533B2

(12) United States Patent
Kuo

(10) Patent No.: US 8,047,533 B2
(45) Date of Patent: Nov. 1, 2011

(54) AUTOMATIC DOCUMENT FEEDER

(75) Inventor: Ping-Hung Kuo, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/725,224

(22) Filed: Mar. 16, 2010

(65) Prior Publication Data

US 2011/0140342 A1 Jun. 16, 2011

(30) Foreign Application Priority Data

Dec. 11, 2009 (TW) ..... 98142462 A

(51) Int. Cl.
*B65H 3/52* (2006.01)

(52) U.S. Cl. ..... 271/121; 271/109

(58) Field of Classification Search ..... 271/121, 271/109

See application file for complete search history.

(56) References Cited

U.S. PATENT DOCUMENTS

| | | | | |
|---|---|---|---|---|
| 6,651,972 | B2 * | 11/2003 | Hsiao et al. | 271/114 |
| 7,255,339 | B2 * | 8/2007 | Hung et al. | 271/122 |
| 7,320,462 | B2 * | 1/2008 | Takamatsu | 271/3.14 |
| 7,837,188 | B2 * | 11/2010 | Lee et al. | 271/117 |
| 2001/0040338 | A1 * | 11/2001 | Kuo et al. | 271/245 |
| 2004/0188918 | A1 * | 9/2004 | Morimoto et al. | 271/121 |
| 2004/0251592 | A1 * | 12/2004 | Ruhe et al. | 271/109 |

* cited by examiner

*Primary Examiner* — Kaitlin Joerger
*Assistant Examiner* — Patrick Cicchino
(74) *Attorney, Agent, or Firm* — Kirton & McConkie; Evan R. Witt

(57) ABSTRACT

An automatic document feeder includes an upper cover, an input tray for placing plural documents, a pick-up module and a stopper module. A guide plate is disposed on the upper cover. The guide plate has a confining aperture. The confining aperture includes a fixing region and a releasing region. The stopper module has a stopping slice inserted into the confining aperture. When the automatic document feeder is enabled and the pick-up module is swung to be close to the input tray, the stopper module is moved from the fixing region of the confining aperture in response to the swinging action of the pick-up module. As such, the stopper module is released and the document is allowed to be fed into the internal portion of the automatic document feeder.

9 Claims, 9 Drawing Sheets

AUTOMATIC DOCUMENT FEEDER

FIELD OF THE INVENTION

The present invention relates to an automatic document feeder, and more particularly to an automatic document feeder with a stopper module.

BACKGROUND OF THE INVENTION

With increasing development of scientific technologies, the method for storing documents is changed from filing of paper documents to storage of documents' electronic files. A scanning apparatus is a device for scanning the contents of paper documents into electronic files, which are then stored, processed or spread.

In the early stage, the scanning apparatus can scan one side of the document. For scanning both sides of the document, the document should be manually turned over after one side of the document has been scanned in order to sequentially scan the other side of the document. However, the process of manually turning over the document is troublesome. Recently, a duplex scanning apparatus has been developed for automatically performing a duplex scanning operation to scan both sides of the document.

Hereinafter, the configurations and operating principles of a conventional automatic document feeder will be illustrated with reference to FIG. 1.

FIG. 1 is a schematic side view illustrating an automatic document feeder disclosed in U.S. Pat. No. 7,530,563. As shown in FIG. 1, the automatic document feeder 1 is operated in a standby mode. The automatic document feeder 1 comprises an upper cover 10, a paper-feeding mechanism 11, a transfer module 12, a paper ejecting module 13, a paper input tray 14 and a paper ejecting tray 15. The document D to be scanned is placed on the paper input tray 14. The scanned document D is supported on the paper ejecting tray 15. The paper-feeding mechanism 11 is used for feeding the document D that is placed on the paper input tray 14 into the internal portion of the automatic document feeder 1. The transfer module 12 is used for transporting the document D through the internal portion of the automatic document feeder 1. The paper ejecting module 13 is used for ejecting the document D to the paper ejecting tray 15. As shown in FIG. 1, the automatic document feeder 1 is integrated into a scanning apparatus, which is arranged under the automatic document feeder 1. The operating principles of the scanning apparatus are known in the art, and are not redundantly described herein.

FIG. 2 is a schematic perspective view illustrating a paper-feeding mechanism of the automatic document feeder shown in FIG. 1. Please refer to FIGS. 1 and 2. The paper-feeding mechanism 11 comprises a pick-up module 111, a supporting module 112 and a stopper module 113. The pick-up module 111 comprises a pick-up roller 1111, a separation roller 1112 and a separation roller axle 1113. The separation roller 1112 is sheathed around a separation roller axle 1113, so that the separation roller 1112 is synchronously rotated with the separation roller axle 1113. The pick-up roller 1111 and the separation roller 1112 are connected with each other through a gear set, so that the pick-up roller 1111 is synchronously rotated with the separation roller 1112. The supporting module 112 has a sustaining part 1121. The stopper module 113 comprises a transmission rod 1131, a stopping slice 1132, a contact part 1133, a clamp part 1134 and a pivotal shaft 1135. The pick-up roller 1111 and the separation roller 1112 are disposed on the supporting module 112. The sustaining part 1121 of the supporting module 112 is also sheathed around the separation roller axle 1113. The pivotal shaft 1135 of the stopper module 113 is penetrated through the upper cover 10. As such, the stopper module 113 is connected to the upper cover 10, and the stopper module 113 is rotatable with respect to the upper cover 10 through the pivotal shaft 1135. The contact part 1133 is disposed at an end of the transmission rod 1131 and arranged in the vicinity of the sustaining part 1121. The clamp part 1134 is disposed at the other end of the transmission rod 1131 for clamping the stopping slice 1132. As such, the stopping slice 1132 is rotatable with respect to the transmission rod 1131.

In a case that the automatic document feeder 1 is disabled, the document D is stopped from being transported into the internal portion of the automatic document feeder 1 by the stopping slice 1132 (see FIG. 1). Whereas, in a case that the automatic document feeder 1 is enabled, the separation roller axle 1113 is driven and thus the pick-up roller 1111 and the separation roller 1112 are synchronously driven. In this situation, the pick-up roller 1111, the separation roller 1112 and the separation roller axle 1113 are rotated in the clockwise direction. Since the sustaining part 1121 is also sheathed around the separation roller axle 1113, the sustaining part 1121 is rotated in the clockwise direction. At this moment, the sustaining part 1121 is sustained against the contact part 1133 of the stopper module 113. As such, the transmission rod 1131 is rotated in the anti-clockwise direction by using the pivotal shaft 1135 as a rotating shaft. Since the transmission rod 1131 is pivotal about the pivotal shaft 1135, the stopping slice 1132 is uplifted vertically (see FIG. 3). Meanwhile, the document D placed on the paper input tray 14 can be transported into the internal portion of the automatic document feeder 1 without being stopped by the stopping slice 1132.

Although the conventional automatic document feeder 1 has a function of stopping the document D from entering the internal portion thereof when the automatic document feeder 1 is disabled, there are still has two problems. For example, since the stopping slice 1132 is moved in the vertical direction, the upper cover 10 of the automatic document feeder 1 is very high to allow the stopping slice 1132 to be moved vertically within the upper cover 10. In other words, the vertical movement of the stopping slice 1132 is detrimental to minimization of the automatic document feeder 1. Moreover, since the stopping slice 1132 is moved in the vertical direction, if the stopping slice 1132 is moved downwardly to be contact with the document D while the document D is transported across the region under the stopping slice 1132, the document D is readily destroyed by the stopping slice 1132. In this situation, a perforation will be formed in the document D. If the stopping slice 1132 is penetrated through the document D while the document D is transported across the region under the stopping slice 1132, the document D will be suffered from serious damage.

SUMMARY OF THE INVENTION

It is an object of the present invention to provide an automatic document feeder having small volume.

Another object of the present invention provides an automatic document feeder to minimize the possibility of damaging the document.

In accordance with an aspect of the present invention, there is provided an automatic document feeder for feeding plural documents. The automatic document feeder includes an upper cover, an input tray, a transfer channel, a guide plate, a pick-up module and a stopper module. The upper cover has an inner surface. The input tray is used for placing the plural documents. The guide plate is disposed on and perpendicular to the upper cover of the inner surface for guiding the plural documents to move through the transfer channel. The guide plate has a confining aperture. The confining aperture includes a fixing region and a releasing region, which are in communication with each other. The pick-up module is used for feeding the plural documents on the input tray into the transfer channel. The pick-up module includes a sustaining element. The stopper module is used for stopping the plural documents from entering the transfer channel. The stopper module includes a stopping slice and a poking element. The stopping slice has a protrusion inserted into the confining aperture. The poking element is disposed on the guide plate and connected with the stopping slice. The poking element is rotatable with respect to the upper cover. When the pick-up module is driven to move toward the input tray, the sustaining element of the pick-up module is sustained against the poking element and the stopping slice is moved by the poking element, so that the protrusion of the stopping slice is moved from the fixing region of the confining aperture to the releasing region to release the stopping slice. After the pick-up module is in contact with a first document of the plural documents on the input tray, the first document is transported by the pick-up module to push the stopping slice, so that the first document is allowed to be fed into the transfer channel.

In an embodiment, the stopping slice further includes a moving frame. An end of the poking element is inserted into the moving frame and movable within the moving frame. As the poking element is rotated, the stopping slice is synchronously moved.

In an embodiment, the automatic document feeder further includes a stopping indentation for accommodating the stopping slice.

In an embodiment, when the pick-up module is driven to swing in a clockwise direction to be close to the input tray, the sustaining element of the pick-up module is sustained against the poking element and the stopping slice is moved by the poking element, so that the poking element is rotated in an anti-clockwise direction to have the protrusion move from the fixing region of the confining aperture to the releasing region. After the pick-up module is in contact with the first document and the first document is transported by the pick-up module, the first document pushes the stopping slice to have the stopping slice detach from the stopping indentation, so that the first document is allowed to be fed into the transfer channel.

In an embodiment, when the protrusion of the stopping slice is inserted into the fixing region of the confining aperture, the fixing region and the protrusion are engaged with each other. Whereas, when the protrusion is moved to the releasing region, the protrusion is received in and movable within the releasing region.

In an embodiment, the area of the releasing region is greater than that of the fixing region.

In an embodiment, the confining aperture has a key-hole profile.

In an embodiment, the sustaining element is integrated into the pick-up module.

In an embodiment, the pick-up module further includes a pick-up roller and a separation roller. The pick-up roller is for feeding the first document from the input tray to the transfer channel. The separation roller is used for separating the first document from a second document underlying the first document, so that only the first document is allowed to be fed into the transfer channel.

In an embodiment, the pick-up module further includes a driving shaft, which is sheathed by the separation roller for driving the separation roller and the pick-up roller.

In an embodiment, said automatic document feeder further includes an ejecting tray, a transfer roller and an ejecting roller. The ejecting tray is disposed under the input tray for supporting the plural documents that are ejected from the transfer channel. The transfer roller is disposed beside the transfer channel for transporting the plural documents through the transfer channel. The ejecting roller is disposed at a side of the ejecting tray for transporting the plural documents to the ejecting tray.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
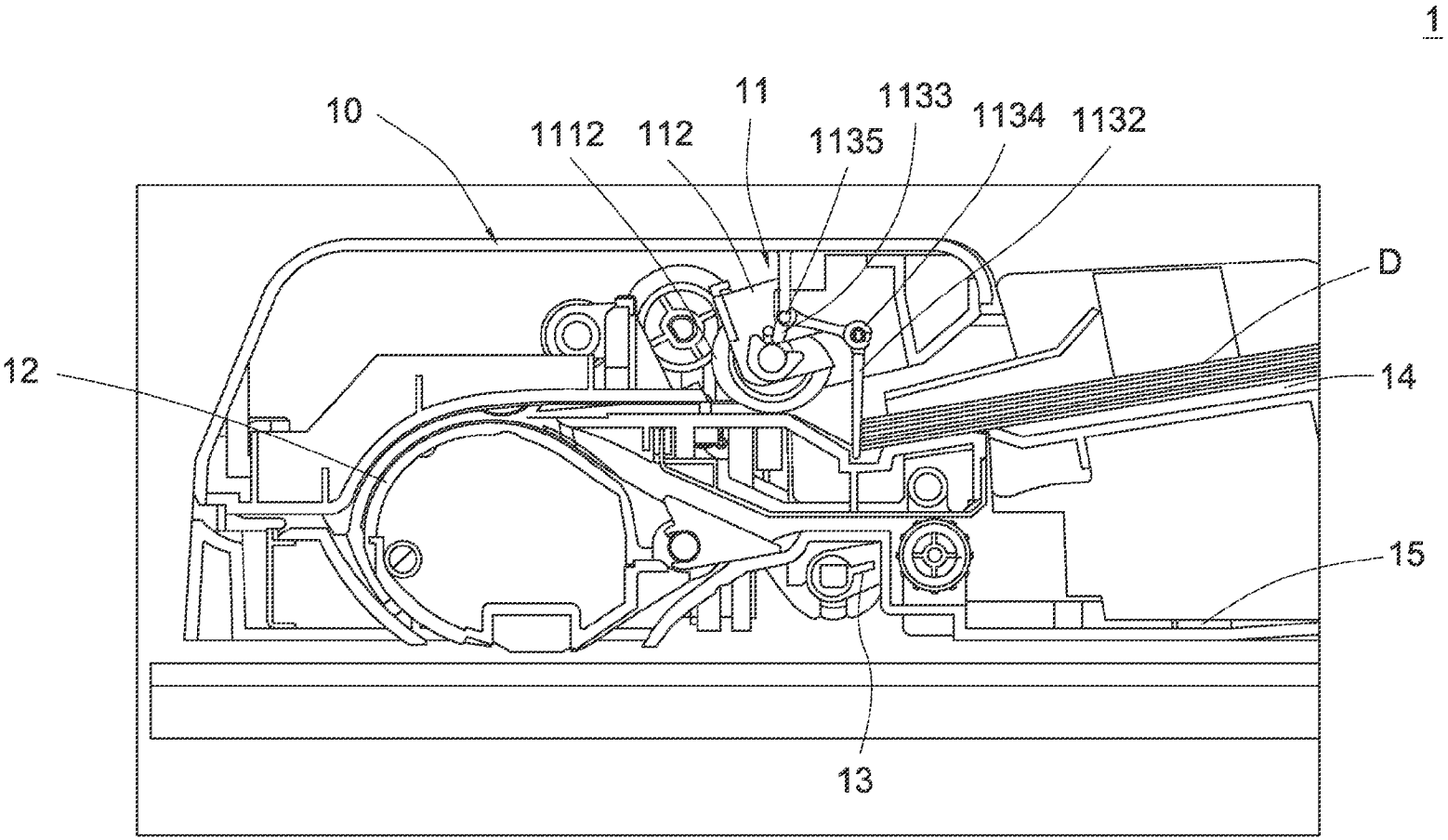
FIG. 1(PRIOR ART)
FIG. 1 is a schematic side view illustrating an automatic document feeder in a standby mode according to the prior art.
Figure 2:
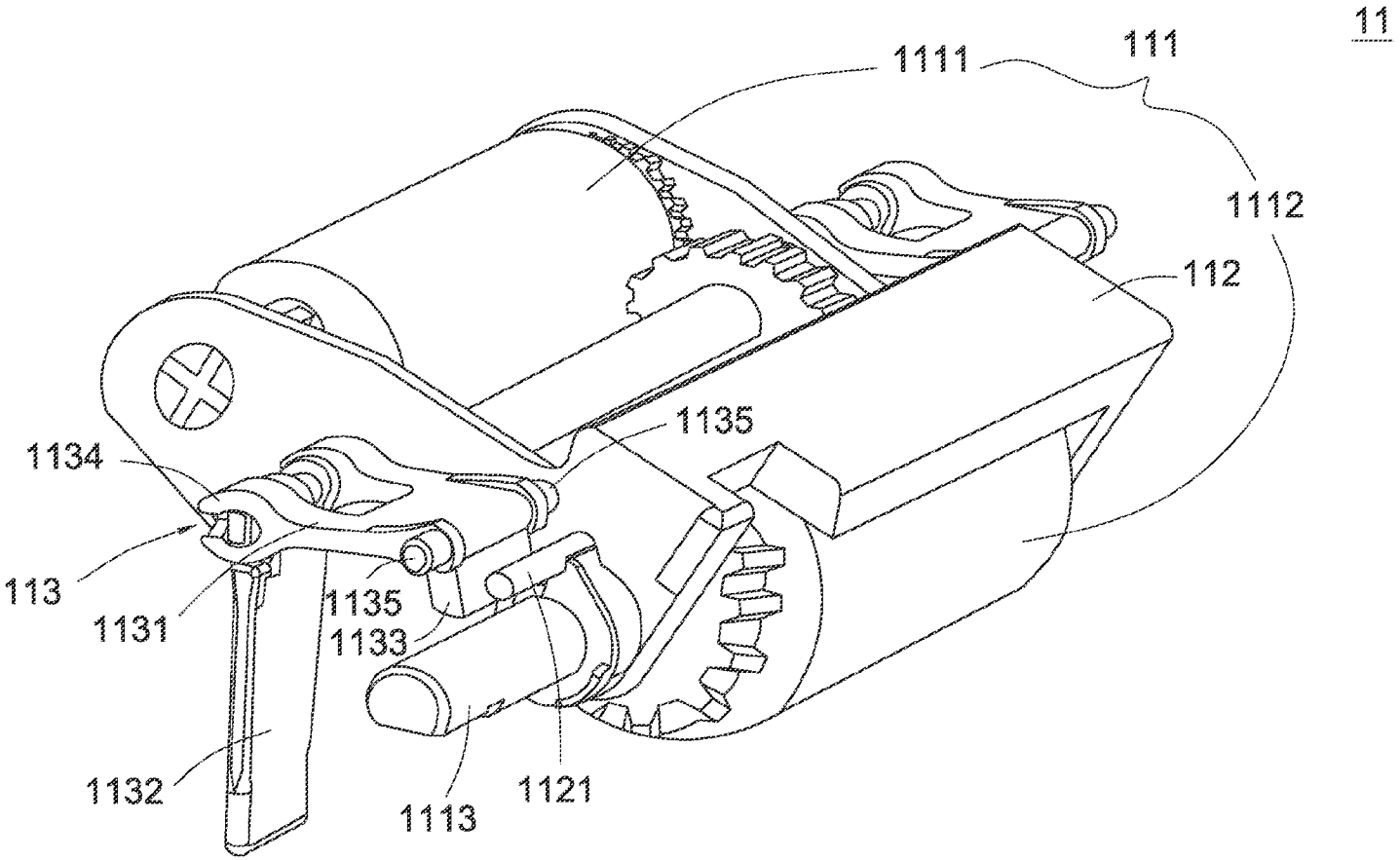
FIG. 2(PRIOR ART)
FIG. 2 is a schematic perspective view illustrating a paper-feeding mechanism of the automatic document feeder shown in FIG. 1.
Figure 3:
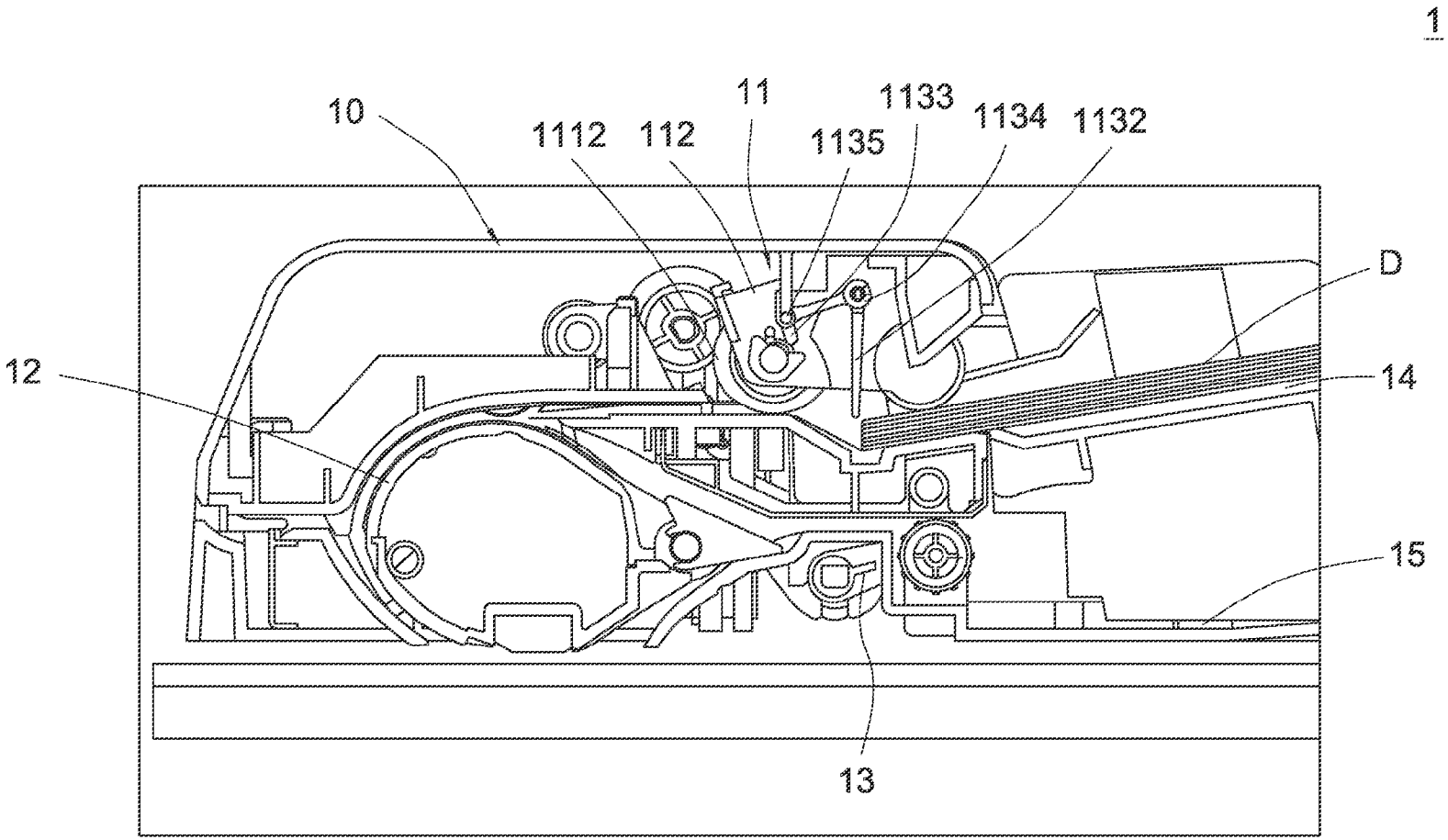
FIG. 3(PRIOR ART)
FIG. 3 is a schematic side view illustrating the automatic document feeder in a feeding mode according to the prior art.
Figure 4:
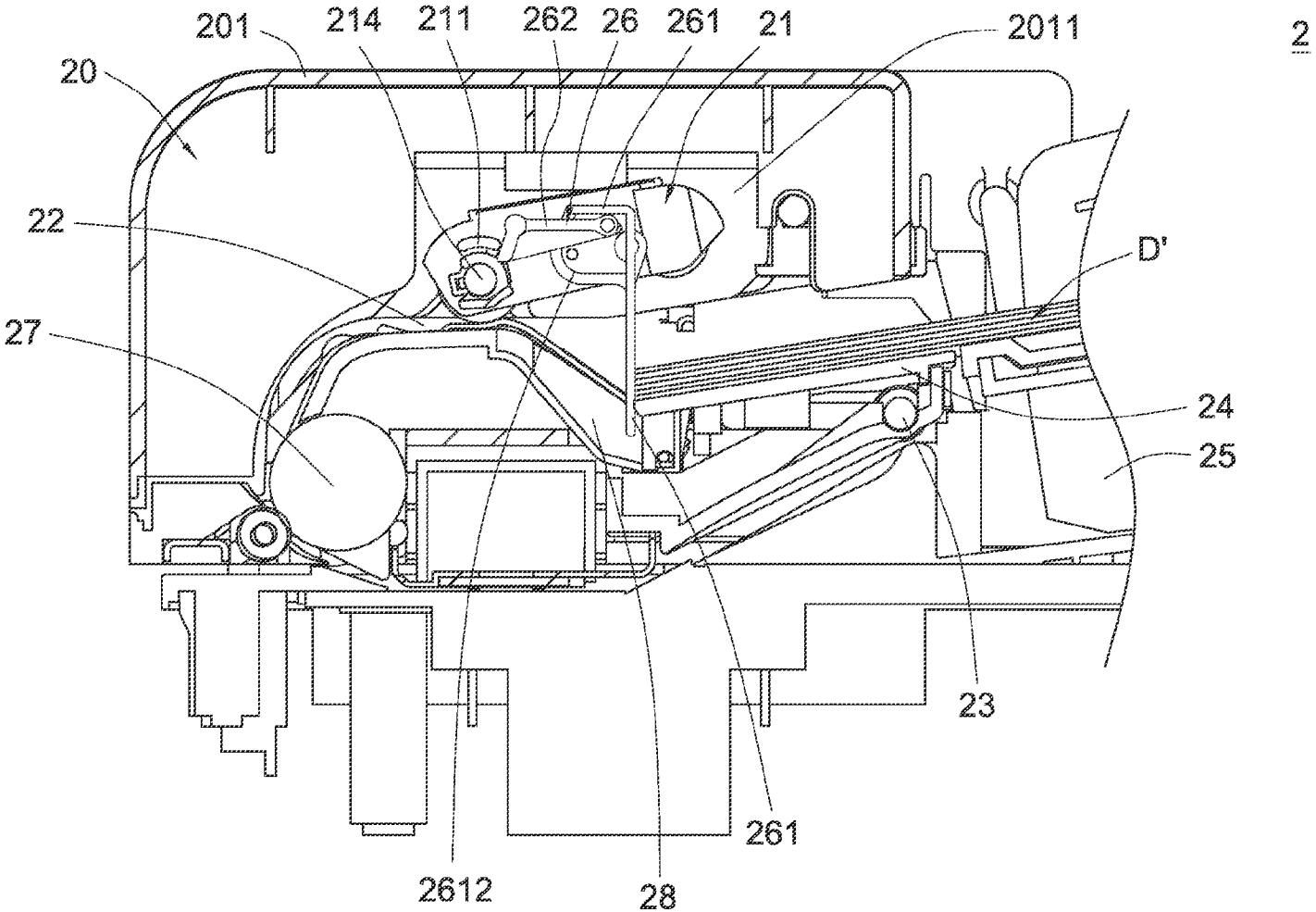
FIG. 4 is a schematic side view illustrating an automatic document feeder in a standby mode according to an embodiment of the present invention.

For obviating the drawbacks encountered from the prior art, the present invention provides an automatic document feeder. FIG. 4 is a schematic side view illustrating an automatic document feeder in a standby mode according to an embodiment of the present invention. The automatic document feeder 2 comprises an upper cover 20, a pick-up module 21, a transfer channel 22, an ejecting roller 23, an input tray 24, an ejecting tray 25, a stopper module 26, a transfer roller 27 and a stopping indentation 28. Plural documents D' to be scanned are placed on the input tray 24. The scanned documents D' are supported on the ejecting tray 25. The pick-up module 21 is used for successively feeding the documents D' that are placed on the input tray 24 into the internal portion of the automatic document feeder 2. After the documents D' are fed into the internal portion of the automatic document feeder 2, the documents D' are transported through the transfer channel 22. The transfer roller 27 is arranged beside the transfer channel 22 for transporting the documents D' through the transfer channel 22. The stopper module 26 is used for stopping the documents D' from being fed into the transfer channel 22. The stopping indentation 28 is used for accommodating a stopping slice 261 of the stopper module 26. The ejecting roller 23 is used for successively ejecting the documents D' to the ejecting tray 25.

Figure 5:
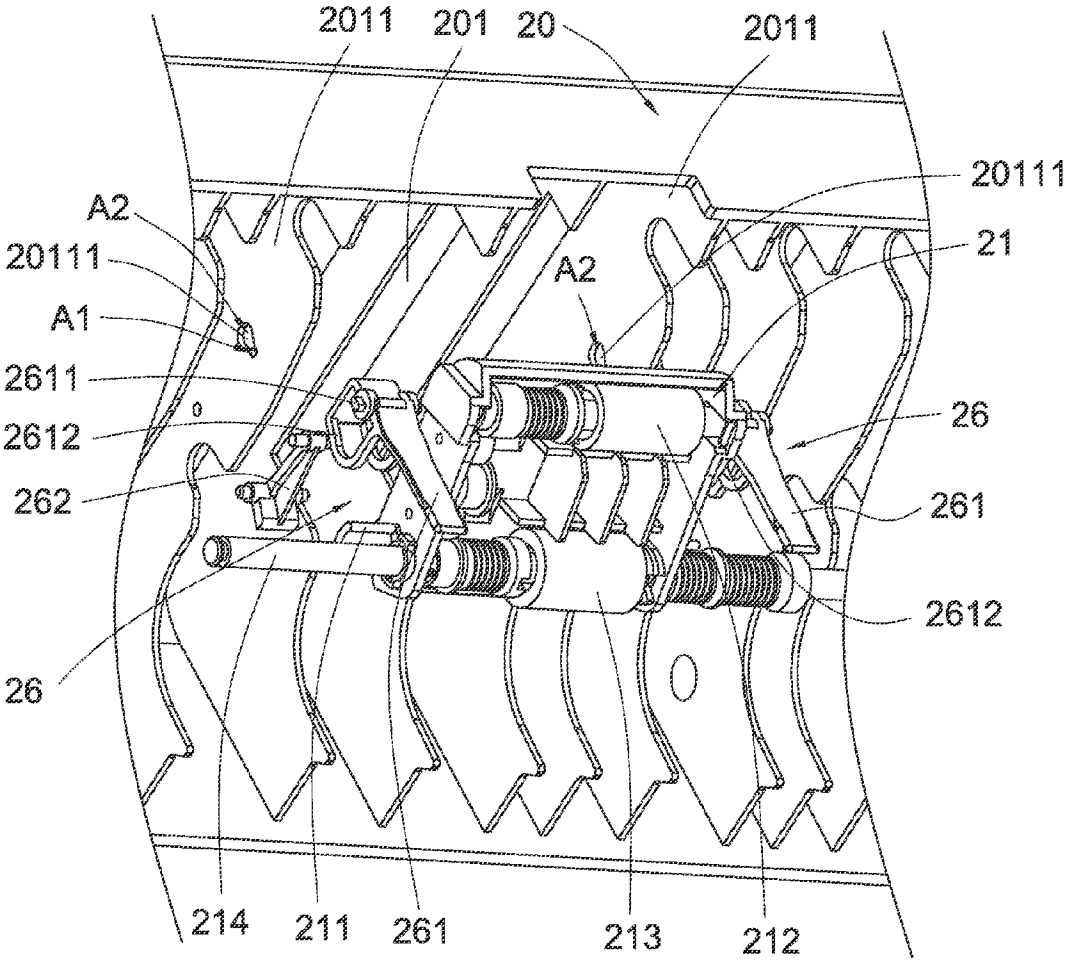
FIG. 5 is a schematic exploded view illustrating the automatic document feeder as shown in FIG. 4.

FIG. 5 is a schematic exploded view illustrating the automatic document feeder as shown in FIG. 4. Hereinafter, the configurations of the automatic document feeder of the present invention will be illustrated with reference to FIGS. 4 and 5. As shown in FIG. 5, the automatic document feeder 2 comprises two stopper modules 26. The upper cover 20 of the automatic document feeder 2 has an inner surface 201. A guide plate 2011 is disposed on and perpendicular to the inner surface 201 for guiding the documents D' to move through the transfer channel 22. The guide plate 2011 has a confining aperture 20111. The confining aperture 20111 comprises a fixing region A1 and a releasing region A2, which are in communication with each other. The area of the releasing region A2 is greater than that of the fixing region A1. In this embodiment, the confining aperture 20111 has a key-hole profile (see FIG. 5).

Please refer to FIG. 5 again. The pick-up module 21 comprises a sustaining element 211, a pick-up roller 212, a separation roller 213 and a driving shaft 214. The separation roller 213 is sheathed around the driving shaft 214. By the pick-up roller 212, a first document D1' of the plural documents D' is fed from the input tray 24 into the transfer channel 22. By the separation roller 213, the first document D1' is separated from a second document D2' underlying the first document D1', so that only the first document D1' is fed into the transfer channel 22. The driving shaft 214 is used for driving the separation roller 213 and the pick-up roller 212. Moreover, the separation roller 213 and the pick-up roller 212 may be connected with each other through a transmission belt (not shown) or a gear set. It is preferred that the sustaining element 211 is integrated into the pick-up module 21.

The stopper module 26 comprises a stopping slice 261 and a poking element 262. The stopping slice 261 has a protrusion 2611 and a moving frame 2612. The protrusion 2611 is inserted into the confining aperture 20111. The poking element 262 is disposed on the guide plate 2011 and connected with the stopping slice 261. The poking element 262 is rotatable with respect to the upper cover 20. An end of the poking element 262 is inserted into the moving frame 2612, and movable within the moving frame 2612. As the poking element 262 is rotated, the stopping slice 261 is synchronously moved.

Figure 6:
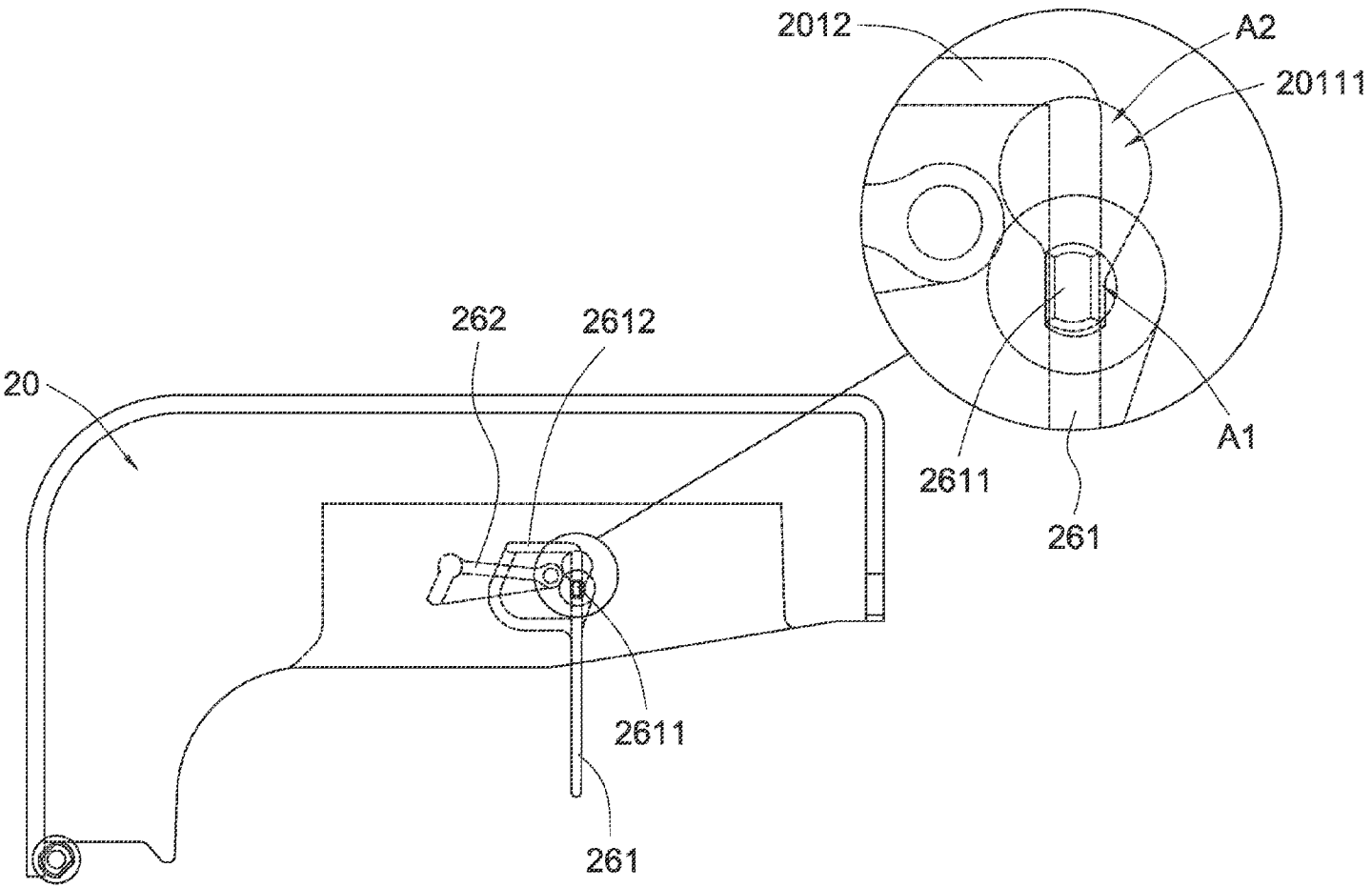
FIG. 6 is a schematic partial side view illustrating the automatic document feeder in a standby mode according to the present invention.

FIG. 6 is a schematic partial side view illustrating the automatic document feeder in a standby mode according to the present invention. Hereinafter, the operating principles of the automatic document feeder of the present invention will be illustrated with reference to FIGS. 4 and 6. As shown in FIG. 4, when the automatic document feeder 2 is disabled, the pick-up module 21 is distant from the input tray 24 by a gap. In addition, the stopping slice 261 of the stopper module 26 is inserted into the stopping indentation 28. The protrusion 2611 of the stopping slice 261 is inserted into the confining aperture 20111. Moreover, the protrusion 2611 is located at the fixing region A1 of the confining aperture 20111. Since the protrusion 2611 is engaged with the fixing region A1, the stopping slice 261 is fixed on the guide plate 2011 to exhibit the function of stopping the plural documents D' (see FIG. 6). When the automatic document feeder 2 is enabled to feed the plural documents D', the driving motor (not shown) connected to the driving shaft 214 is activated to drive the driving shaft 214.

Figure 7A:
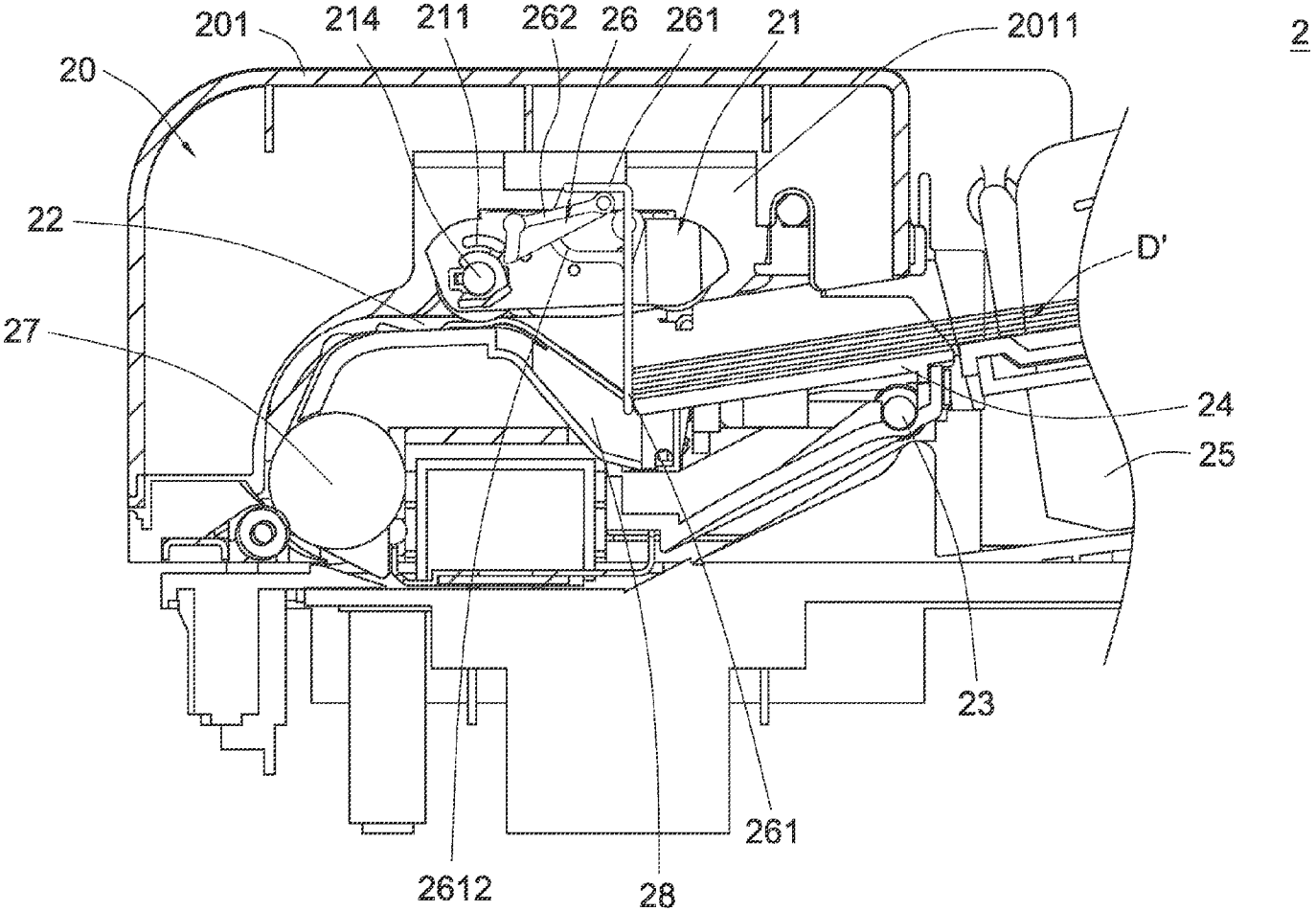
FIGS. 7A and 7B are schematic side views illustrating the automatic document feeder in a feeding mode according to and embodiment of the present invention.
Figure 7B:
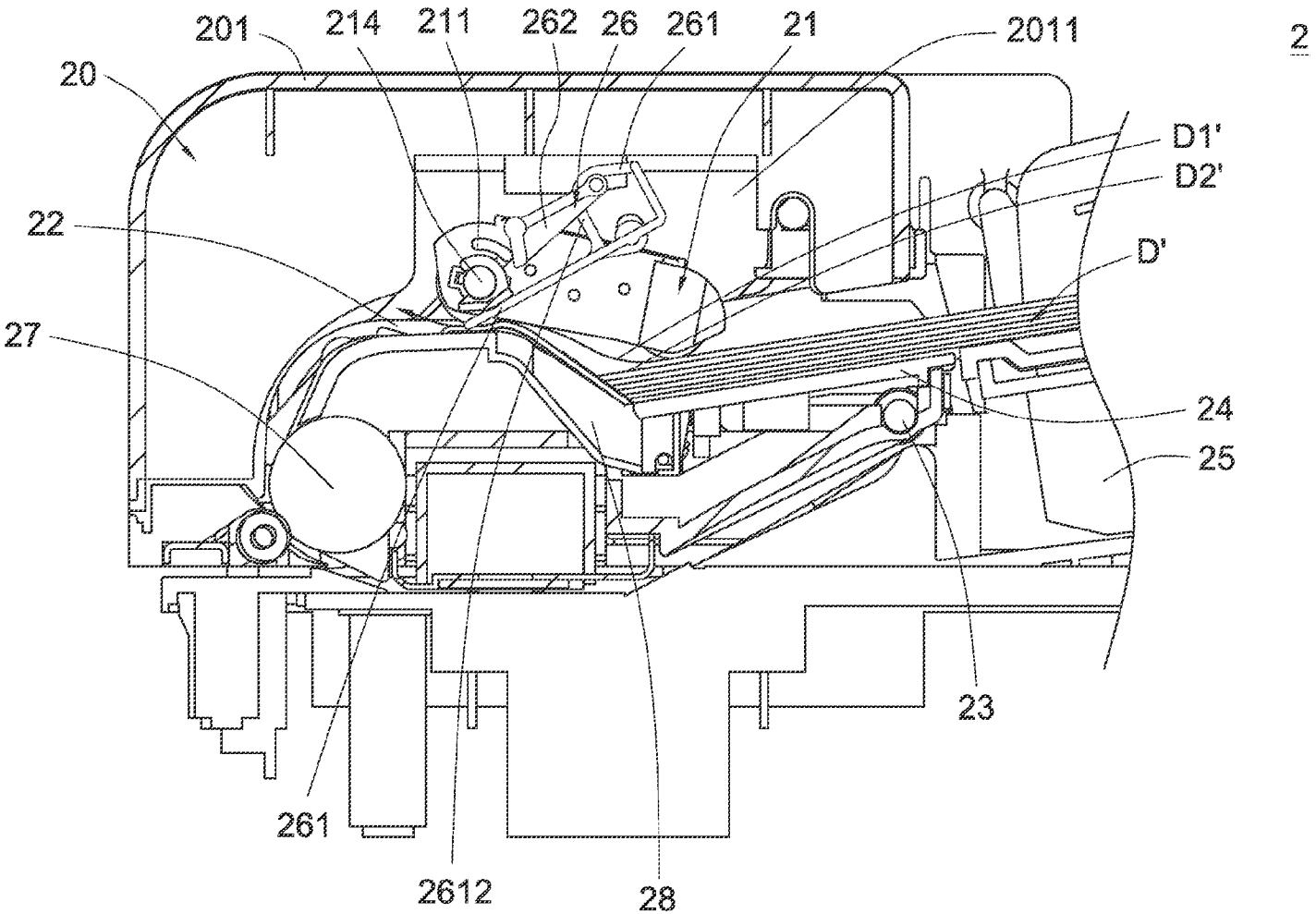
Figure 8:
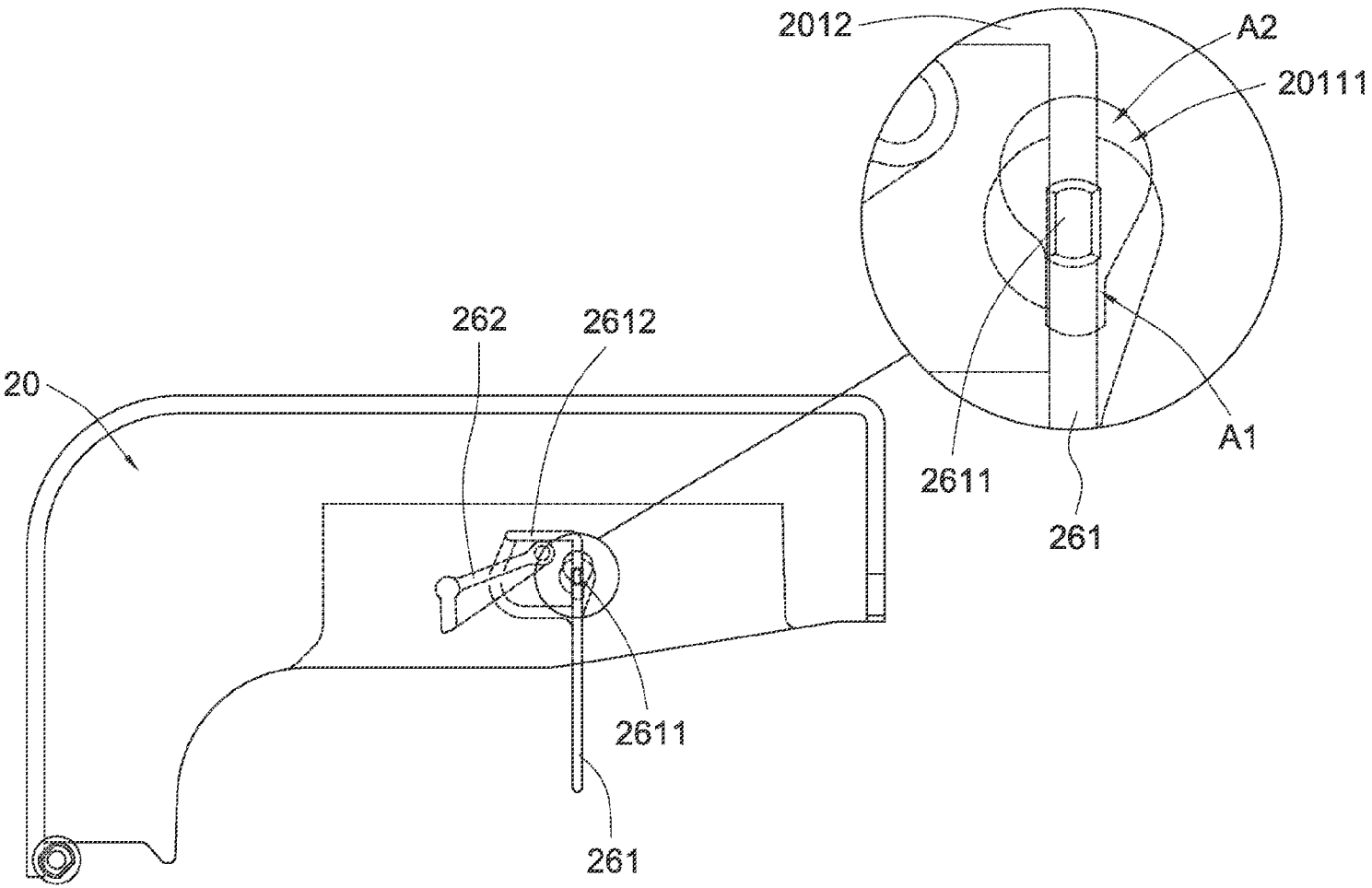
FIG. 8 is a schematic partial side view illustrating the automatic document feeder in a feeding mode according to the present invention.

FIGS. 7A and 7B are schematic side views illustrating the automatic document feeder in a feeding mode according to and embodiment of the present invention. As shown in FIG. 7A, when the driving shaft 214 is driven by the driving motor, the pick-up module 21 is driven by the driving shaft 214. As such, the pick-up roller 212 and the separation roller 213 are synchronously rotated in the clockwise direction. As the driving shaft 214 is driven to rotate in the clockwise direction, the pick-up module 21 is swung in the clockwise direction to be close to the input tray 24. As the pick-up module 21 is continuously swung, the sustaining element 211 of the pick-up module 21 will be sustained against the poking element 262. At this moment, the poking element 262 is rotated in the anti-clockwise direction to move the stopping slice 261. As such, the protrusion 2611 of the stopping slice 261 is moved from the fixing region A1 of the confining aperture 20111 to the releasing region A2. Meanwhile, the stopping slice 261 is released (see FIG. 8).

After the protrusion 2611 is moved to the releasing region A2, the pick-up module 21 is swung to be contacted with the plural documents D' on the input tray 24. Meanwhile, the pick-up roller 212 of the pick-up module 21 is in contact with the first document D1' of the plural documents D'. Upon rotation of the pick-up roller 212, the first document D1' is transported by the pick-up roller 212. As the first document D1' advances, the stopping slice 261 of the stopper module 26 is pushed by the first document D1' and thus the stopping slice 261 is detached from the stopping indentation 28. As such, the first document D1' is allowed to be fed into the transfer channel 22 (see FIG. 7B). During the process of transporting the first document D1', the first document D1' and the second document D2' underlying the first document D1' are simultaneously transported by the pick-up roller 212. Once the first document D1' and the second document D2' are transported across the separation roller 213, the first document D1' is separated from the second document D2' by the separation roller 213. As such, only the first document D1' is allowed to be fed into the transfer channel 22. Next, the remaindering documents D' are successively fed into the transfer channel 22. The processes of feeding the remaindering documents D' are similar to the process of feeding the first document D1', and are not redundantly described herein. After the plural documents D' on the input tray 24 have been fed into the transfer channel 22, the stopping slice 261 is no longer pushed by the documents D'. As such, the stopping slice 261 is returned to be received in the stopping indentation 28. Similarly, the other components are returned to their original position where the automatic document feeder 2 is in the standby mode.

As previously described, the stopping slice of the conventional automatic document feeder is only allowed to move vertically. According to the automatic document feeder of the present invention, the stopping slice is first vertically moved in confining aperture to a small extent, and then swung upwardly. As a consequence, the possibility of damaging the document during the process of moving the document will be eliminated. Moreover, since the confining aperture is formed in the guide plate of the upper cover according to the automatic document feeder of the present invention, the movement of the stopping slice is restricted within the range of the confining aperture. In other words, the stopping slice is allowed to move in the vertical direction to a small extent. Since the height required for allowing the stopping slice 1132 to move in the vertical direction is reduced, the minimization of the automatic document feeder is possible. Therefore, the automatic document feeder is capable of obviating the drawbacks encountered from the prior art.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding plural documents, said automatic document feeder comprising:

an upper cover having an inner surface;

an input tray for placing said plural documents;

a transfer channel;

a guide plate disposed on and perpendicular to said upper cover of said inner surface for guiding said plural documents to move through said transfer channel, wherein said guide plate has a confining aperture, and said confining aperture comprises a fixing region and a releasing region, which are in communication with each other;

a pick-up module for feeding said plural documents on said input tray into said transfer channel, wherein said pick-up module comprises a sustaining element;

a stopper module for stopping said plural documents from entering said transfer channel, said stopper module comprising a stopping slice and a poking element, wherein said stopping slice has a protrusion inserted into said confining aperture, said poking element is disposed on said guide plate and connected with said stopping slice, and said poking element is rotatable with respect to said upper cover; and a stopping indentation for accommodating said stopping slice, wherein when said pick-up module is driven to move toward said input tray, said sustaining element of said pick-up module is sustained against said poking element and said stopping slice is moved by said poking element, so that said protrusion of said stopping slice is moved from said fixing region of said confining aperture to said releasing region to release said stopping slice, wherein after said pick-up module is in contact with a first document of said plural documents on said input tray, said first document is transported by said pick-up module to push said stopping slice, so that said first document is allowed to be fed into said transfer channel, and wherein when said pick-up module is driven to swing in a clockwise direction to be close to said input tray, said sustaining element of said pick-up module is sustained against said poking element and said stopping slice is moved by said poking element, so that said poking element is rotated in an anti-clockwise direction to have said protrusion move from said fixing region of said confining aperture to said releasing region, wherein after said pick-up module is in contact with said first document and said first document is transported by said pick-up module, said first document pushes said stopping slice to have said stopping slice detach from said stopping indentation, so that said first document is allowed to be fed into said transfer channel.

2. The automatic document feeder according to claim 1 wherein said stopping slice further comprises a moving frame, and an end of said poking element is inserted into said moving frame and movable within said moving frame, wherein as said poking element is rotated, said stopping slice is synchronously moved.

3. The automatic document feeder according to claim 1 wherein when said protrusion of said stopping slice is inserted into said fixing region of said confining aperture, said fixing region and said protrusion are engaged with each other, wherein when said protrusion is moved to said releasing region, said protrusion is received in and movable within said releasing region.

4. The automatic document feeder according to claim 1 wherein the area of said releasing region is greater than that of said fixing region.

5. The automatic document feeder according to claim 1 wherein said confining aperture has a key-hole profile.

6. The automatic document feeder according to claim 1 wherein said sustaining element is integrated into said pick-up module.

7. The automatic document feeder according to claim 1 wherein said pick-up module further comprises:

a pick-up roller for feeding said first document from said input tray to said transfer channel; and a separation roller for separating said first document from a second document underlying said first document, so that only said first document is allowed to be fed into said transfer channel.

8. The automatic document feeder according to claim 7 wherein said pick-up module further comprises a driving shaft, which is sheathed by said separation roller for driving said separation roller and said pick-up roller.

9. The automatic document feeder according to claim 1 further comprising:

an ejecting tray disposed under said input tray for supporting said plural documents that are ejected from said transfer channel;

a transfer roller disposed beside said transfer channel for transporting said plural documents through said transfer channel; and an ejecting roller disposed at a side of said ejecting tray for transporting said plural documents to said ejecting tray.

* * * * *